US010370931B2

(12) United States Patent
Carragher

(10) Patent No.: US 10,370,931 B2
(45) Date of Patent: Aug. 6, 2019

(54) METHODS AND APPARATUS FOR USE IN OIL AND GAS WELL COMPLETION

(71) Applicant: BISN TEC LTD., Runcorn, Cheshire (GB)

(72) Inventor: Paul Carragher, Lymm (GB)

(73) Assignee: BiSN Tec Ltd., Warrington (GB)

( * ) Notice: Subject to any disclaimer, the term of this patent is extended or adjusted under 35 U.S.C. 154(b) by 0 days.

(21) Appl. No.: 15/502,966

(22) PCT Filed: Aug. 14, 2015

(86) PCT No.: PCT/GB2015/052347
§ 371 (c)(1),
(2) Date: Feb. 9, 2017

(87) PCT Pub. No.: WO2016/024122
PCT Pub. Date: Feb. 18, 2016

(65) Prior Publication Data

US 2017/0234100 A1 Aug. 17, 2017

(30) Foreign Application Priority Data

Aug. 15, 2014 (GB) ..... 1414565.0
Apr. 2, 2015 (GB) ..... 1505750.8

(51) Int. Cl.
*E21B 33/13* (2006.01)
*E21B 33/122* (2006.01)
(Continued)

(52) U.S. Cl.
CPC ..... *E21B 33/122* (2013.01); *E21B 17/042* (2013.01); *E21B 19/00* (2013.01);
(Continued)

(58) Field of Classification Search
CPC ..... E21B 33/122; E21B 31/007
(Continued)

(56) References Cited

U.S. PATENT DOCUMENTS 1,534,229 A 4/1925 Livergood
2,686,689 A 8/1954 Douglas
(Continued)

FOREIGN PATENT DOCUMENTS

CA 2592556 6/2007
EP 1 933 004 6/2008
(Continued)

OTHER PUBLICATIONS

International Search Report PCT/GB2015/052347.
PCT/GB2015/052347 Written Opinion.

*Primary Examiner* — Taras P Bemko
(74) *Attorney, Agent, or Firm* — Glen P. Belvis; Belvis Law, LLC.

(57) ABSTRACT

A first aspect of the invention provides a gas or oil well tubing having an annular packer mounted thereon, wherein the annular packer is formed from an eutectic alloy. By prefabricating the annular packer on the tubing it can be placed in situ from the outset and thus can be active by melting at any time to form a eutectic seal quickly and easily. An annular packer with by-pass conduits is also provided to enable cement to be pumped past the annular packer when it is in situ. The annular packer is further provided with conduit clearance means to clear cement from within the conduits.

3 Claims, 14 Drawing Sheets

(51) Int. Cl.

| | |
|---|---|
| ***E21B 31/00*** | (2006.01) |
| ***E21B 29/10*** | (2006.01) |
| ***E21B 17/042*** | (2006.01) |
| ***E21B 41/00*** | (2006.01) |
| ***E21B 19/00*** | (2006.01) |
| ***E21B 33/14*** | (2006.01) |
| ***E21B 43/10*** | (2006.01) |

(52) U.S. Cl.
CPC ..... *E21B 29/10* (2013.01); *E21B 31/007* (2013.01); *E21B 33/13* (2013.01); *E21B 33/14* (2013.01); *E21B 41/00* (2013.01); *E21B 43/10* (2013.01)

(58) Field of Classification Search
USPC ..... 166/277
See application file for complete search history.

(56) References Cited

U.S. PATENT DOCUMENTS

| | | | |
|---|---|---|---|
| 2,789,004 | A | 4/1957 | Forster |
| 2,822,876 | A | 2/1958 | Murrow |
| 3,119,451 | A | 1/1964 | Hall |
| 3,170,516 | A | 2/1965 | Corley |
| 3,208,530 | A | 9/1965 | Allen |
| 3,871,315 | A | 3/1975 | Anderson |
| 4,134,452 | A | 1/1979 | Kingelin |
| 4,423,783 | A | 1/1984 | Haag |
| 4,488,747 | A | 12/1984 | Austin |
| 4,523,640 | A | 6/1985 | Wilson |
| 4,696,343 | A | 9/1987 | Anderson |
| 5,052,489 | A | 10/1991 | Carisella |
| 5,564,861 | A | 10/1996 | Khudenko |
| 6,102,120 | A | 8/2000 | Chen |
| 6,454,001 | B1 | 9/2002 | Thompson |
| 6,474,414 | B1 | 11/2002 | Gonzalez |
| 6,664,522 | B2 | 12/2003 | Spencer |
| 6,828,531 | B2 | 12/2004 | Spencer |
| 6,923,263 | B2 | 8/2005 | Edin |
| 7,152,657 | B2 | 12/2006 | Bosma |
| 7,290,609 | B2 | 11/2007 | Wardlaw |
| 2002/0162596 | A1 | 4/2002 | Simpson |
| 2002/0056553 | A1 | 5/2002 | Duhon |
| 2003/0132224 | A1 | 7/2003 | Spencer |
| 2004/0149418 | A1* | 8/2004 | Bosma ..... E21B 29/10 164/98 |
| 2004/0261994 | A1 | 12/2004 | Nguyen |
| 2005/0109511 | A1 | 5/2005 | Spencer |
| 2005/0217860 | A1* | 10/2005 | Mack ..... E21B 33/1275 166/369 |
| 2006/0144591 | A1 | 7/2006 | Gonzalez |
| 2007/0051514 | A1 | 3/2007 | La Rovere |
| 2010/0006289 | A1 | 1/2010 | Spencer |
| 2010/0263876 | A1 | 10/2010 | Frazier |
| 2011/0132223 | A1 | 6/2011 | Streibich |
| 2011/0146519 | A1 | 6/2011 | Han |
| 2011/0155377 | A1* | 6/2011 | Laun ..... E21B 33/12 166/308.1 |
| 2011/0174484 | A1 | 7/2011 | Wright |
| 2011/0214855 | A1 | 9/2011 | Hart |
| 2012/0132438 | A1* | 5/2012 | Telfer ..... E21B 23/04 166/373 |
| 2012/0199351 | A1 | 8/2012 | Roberston |
| 2012/0298359 | A1 | 11/2012 | Eden |
| 2013/0087335 | A1 | 4/2013 | Carraher |
| 2013/0192833 | A1 | 8/2013 | Gano |
| 2014/0318782 | A1 | 10/2014 | Bourque |
| 2015/0211326 | A1 | 7/2015 | Lowry |
| 2015/0211327 | A1 | 7/2015 | Lowry |
| 2015/0211328 | A1 | 7/2015 | Lowry |
| 2015/0345248 | A1 | 12/2015 | Carragher |
| 2015/0368542 | A1 | 12/2015 | Carragher |
| 2016/0145962 | A1 | 5/2016 | Carragher |
| 2016/0319633 | A1 | 11/2016 | Cooper |
| 2017/0030162 | A1 | 2/2017 | Carragher |
| 2017/0089168 | A1 | 3/2017 | Carragher |
| 2017/0226819 | A1 | 8/2017 | Carragher |
| 2017/0234093 | A1 | 8/2017 | Carragher |
| 2017/0234100 | A1 | 8/2017 | Carragher |
| 2017/0306717 | A1 | 10/2017 | Carragher |

FOREIGN PATENT DOCUMENTS

| | | |
|---|---|---|
| GB | 2 016 063 | 9/1979 |
| GB | 2 164 886 | 4/1986 |
| WO | WO 2011/151171 | 12/2011 |
| WO | WO 2013/066340 | 5/2013 |

* cited by examiner

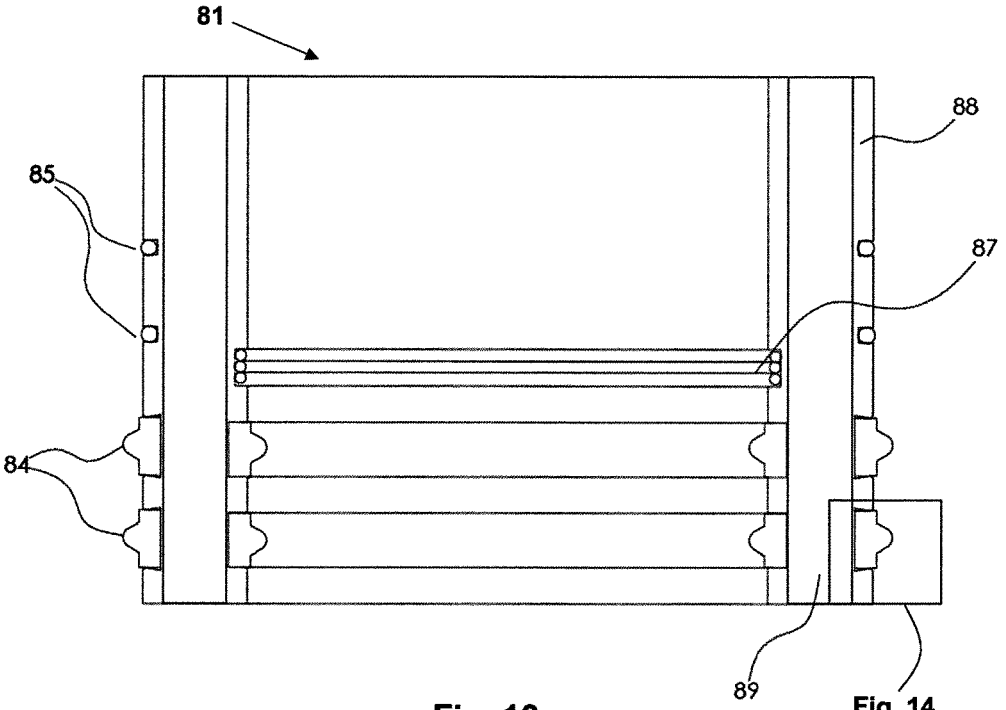
Fig. 13
Fig. 14
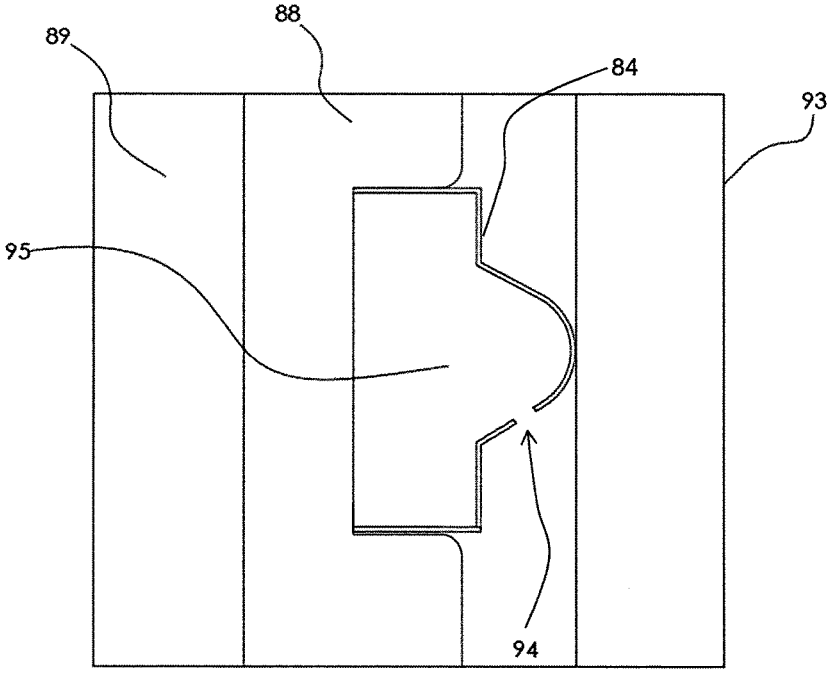
Fig. 14

METHODS AND APPARATUS FOR USE IN OIL AND GAS WELL COMPLETION

FIELD OF THE INVENTION

The present invention relates to apparatus and associated methods used in the formation of oil and gas wells, and in particular the tubing (e.g. lining, casing or production tubing) employed during the creation of oil and gas wells.

BACKGROUND OF THE INVENTION

In order to access oil and gas deposits located in underground formations it is necessary to drill bore holes into these underground formation and deploy production tubing to facilitate the extraction of the oil and gas deposits.

Additional tubing, in the form of well lining or well casing, may also deployed in locations where the underground formation is unstable and needs to held back to maintain the integrity of the oil/gas well.

During the formation and completion of an oil/gas well it is crucial to seal the annular space created between the casing and the surrounding formation. Also the annular space between the different sizes casings used as the well is completed. Additionally the annular space between the production tubing and said casing needs to be sealed. Further seals may be required between the underground formation and the additional tubing.

One of the most common approaches to sealing oil/gas wells is to pump cement into the annular spaces around the casing. The cement hardens to provide a seal which helps ensure that the casing provides the only access to the underground oil and gas deposits. This is crucial for both the efficient operation of the well and controlling any undesirable leakage from the well during or after the well is operated.

However it is not uncommon for crack/gaps (sometime referred to as micro annuli) to form in these cement seals over time, which lead to unwanted leakage from the well. One location where such cracks/gaps can form is at the interface between the production tubing and the cement seal.

In particular, when an oil/gas well is being operated in periodic, stop/start, manner the temperature within the production tubing can fluctuate significantly. These temperature fluctuations can cause the diameter of the production tubing to expand and contract. This movement applies pressure to the cement seal that can lead to the formation of small cracks/gaps in the seal, through which leakage can occur.

In order to address the formation of such crack/gaps in the cement seal it is known to deploy eutectic alloy, such as bismuth alloy, into the annular space and then heat the alloy to so that it melts and flows into the cracks/gaps. The alloy is then allowed to cool, wherein it expands to form an effective seal.

However there are disadvantages to this approach, not least because it requires at least a partial dismantling of the well so that the alloy can be deployed within the annular space, which can be time consuming and costly in terms of the down time of the well.

Another issue with this approach is ensuring that the alloy is delivered to the target region of the well in consistent and uniform manner so that the level of heat required to melt the alloy can be effectively pre-calculated, for example. This is important given that the process usually takes place deep underground and must be controlled remotely.

SUMMARY OF THE INVENTION

In light of the enduring problem of the above identified crack/gap formation in cement seals a first aspect of the present invention seeks to provide apparatus for effectively sealing well leaks in a less disruptive and more consistent manner that the approaches currently being used.

The first aspect of the present invention provides a gas or oil well tubing having an annular packer mounted thereon, wherein the annular packer is formed from a eutectic alloy or any other bismuth alloy.

In its broadest sense the tubing of the first aspect of the present invention may refer to a section of well lining, a section of well casing or a section of production tubing.

Mounting the eutectic annular packer on the tubing that is then deployed in the formation of an oil/gas well means that the alloy is already in situ within the well. In this way, when a leak is detected it can be remedied by simply heating the region of the tubing where the annular packer is mounted.

It is appreciated that, in use, the tubing of the first aspect of the present invention could be effectively deployed just above the cement seal so that when melted the alloy of the annular packer can quickly and easily flow into any cracks/gaps formed in the cement.

Alternatively the tubing could be completely surrounded by and embedded within the cement.

It is also envisioned that the tubing might effectively be deployed well above the cement seal or even in wells that do not contain a cement seal.

In those cases where a cement seal is employed it is envisioned that whilst the tubing of the first aspect of the present invention may be deployed after the cement seal has been formed, it is considered more likely that the tubing may be deployed within a well bore before the cement seal has been formed.

To this end the annular packer may preferably be provided with one or more conduits running substantially parallel to the tubing. The conduits facilitate the passage of cement beyond the annular packer when it is poured or pumped into the annular space to form the aforementioned seal.

The conduits may be provided as channels in the inner and/or outer circumferential surface of the annular packer. Alternatively the conduits may be provided as through holes in the main body of the annular packer.

In order for the packer to create a gas tight seal it is necessary to remove the cement from any conduits. This can be achieved by squeezed the cement out while the cement is still in liquid form. Alternatively the cement in the conduits can be broken once it has solidified.

In one variant of the first aspect of the present invention the annular packer may be mounted on the inner surface of the tubing. It is envisioned that this arrangement is particularly suitable when the tubing is a well casing or well lining.

In an alternative variant of the first aspect of the present invention the annular packer may be mounted to the outer surface of the tubing.

Preferably, the annular packer may comprise multiple component parts which are combinable to form the complete annulus when mounted on the tubing. In this way the production step of mounting the annular packer on the tubing is made quicker and easier.

Further preferably the multiple component parts may consist of two or more ring segments which can be connected together to form a complete annular packer that encircles the tubing.

Alternatively, or indeed additionally, the annular packer may consist of two of more sections that can be located on the tubing in a stacked arrangement (that is, one on top of another along a length of the tubing). In this way various lengths of annular packer can be achieved by stacking varying numbers of packer sections on the tubing.

Further preferably the stackable packer sections may be provided with alignment means that ensure that the sections stack correctly. This is particularly important so that the conduits of the complete annular packer locate in alignment with one another and in doing ensure that there is a flow path running through the complete annular packer for the cement to pass through.

Preferably the annular packer is provided with one or more resiliently biased conduit clearance means. In one embodiment thereof the conduit clearance means operates by squeezing unset cement from a portion of the conduit to create a gap in the cement when it sets.

In an alternative embodiment thereof the conduit clearance means are held in a 'stretched' state by the annular packer until the alloy of the packer is melted, at which time the conduit clearance means can return to their preferred (i.e. non-stretched) state. In this way the conduit clearance means 'spring back' and apply a breaking force to any cement that may have set within the conduit(s).

Preferably the conduit clearance means may comprise one of more spring rings. The spring rings, which are essentially formed from a metal rod/cable that has been formed into a ring shape, may be mounted on the inner surface of the annular packer or the outer surface. The spring rings may be located within a suitably shaped recess in the inner and outer surfaces of the annular packer.

In the case of a spring ring mounted on the inner surface of the annular packer the spring is resiliently biased towards a larger diameter, whilst in the case of a spring ring mounted on the outer surface of the annular packer the spring is resiliently biased towards a smaller diameter. In this way, regardless of where the spring ring is mounted (i.e. inner packer surface or outer packer surface), the spring ring will always be urged towards the conduit when the alloy of the packer is melted.

Advantageously the resiliently biased conduit clearance means may be provided with a leading edge that is configured to enhance the breaking capability of the conduit clearance means when it is sprung against the cement in the conduit.

Preferably the leading edge comprises a sharpened edge. In one example the spring ring may be provided with a square cross-section and then oriented such that one of the corners of the square provides the breaking/sharpened edge that strikes the cement in the conduit.

Preferably the conduits may have an elliptical cross-section rather than a circular cross-section. It has been discovered that by forcing the cement to set with an elliptical cross-section rather than a circular cross-section the resultant cement can be shattered more easily by the action of the conduit clearance means.

Preferably the annular packer may be provided with one or more rubber seals that are configured to form cement-tight seals between the annular packer and an adjacent well casing or tubing. The rubber seals may be located on the inner surface, the outer surface or on both the inner and outer surfaces of the annular packer so as to facilitate the formation of seals with well casings and tubing that are located either on the outside of the packer or the inside of the packer.

Preferably, in the case of stackable packer sections the packer component parts located at the leading and trailing ends of the annular packer may be formed from a metal, such as aluminium, or another alloy in order to provide increased strength.

In the case of stackable packer sections each section may be provided with one or more rubber seals on the surfaces thereof that make contact with another packer section. In particular it is considered preferable to provide seals around any conduits provided in the packer section so as to provide a cement-tight seal. This is particularly desirable when the conduits are formed through the middle (i.e. main body) of the packer section.

Preferably multiple rubber seals are provided on the leading and trailing sections of a stackable annular packer. This allows for some rubber seals to fail during the deployment of the annular packer and yet still maintain the required seal between adjacent tubing.

This external mounting arrangement is considered particularly suitable when the tubing is production tubing. However, as will now be explained, the inventors have conceived a number of related applications made possible by locating a eutectic alloy annular packer on the outer surface of the tubing.

As already identified the annular packer of the present invention can be provided on various types of well tubing, including well liners and well casings. One specific application of an annular packer on well liners/well casings provides for improvements to liner hangers.

Liner hangers are secured within wells so that well tubing can be deployed within the well hole and hung from the liner hanger. Essentially a liner hanger is a device used to attach or hang liners from the internal wall of a previous casing string.

A second aspect of the present invention relates to the use of the tubing of the first aspect of the present invention in liner hangers.

Preferably the annular packer of the present invention is located at the top section of a well liner. In this way it is possible to form an annular seal between the well liner and an outer surface such as tubing (e.g. a well casing) or even the surrounding formation.

Alternatively the annular packer may be provided on the inner surface of a surrounding tubing, such as a well casing, such that upon melting the annular seal is formed between the well liner and the well casing to create the liner hanger.

In addition to providing a gas tight seal the annular seal may also serve to secure the well liner in place relative to the surrounding surface. That is to say the bond formed by the annular packer is strong enough to provide a weight bearing function.

However, it is appreciated that additional securing means, such as hydraulically operated 'dogs' or 'slips', may also be provided to help securely retain the liner hanger in an operating position.

It is envisaged that the liner hanger of the present invention can be applied to a range of liners, which include drilling liners, production liners, tie-backs, and scab.

A third aspect of the present invention relates to the use of the tubing of the first aspect of the present invention in casing drilling.

Casing or liner drilling is employed when the underground formation being drilled is particularly loose and the well bore will not retain its shape. This approach is considered a quicker alternative to drilling loose formations in alternative stages of drilling and well casing/lining installation. One of the disadvantages of the alternating approach is that the size of the well must gradually decrease which each stage because subsequent casings need to pass through the installed casing.

Drilling fluids (e.g. drilling mud) is used during drilling operations to cool the drilling tool and also help remove swarf (i.e. drilled waste) from the drill face. It is therefore crucial to the drilling operation that drilling fluid levels are maintained at the drill face. However the path of a drill can sometimes pass through a cavity or fissure in the underground formation.

Such cavities/fissures can provide routes of egress for the drilling fluids flow away, thereby negatively affecting the drilling fluid levels and requiring drilling operations to be stopped until the cavity/fissure can be plugged to prevent the drilling fluid being lost. Typically the process of plugging the cavity/fissure requires the complete removal of the drilling tool so that suitable plugging material (such as cement) can be delivered down the well bore to close off the cavity/fissure.

The third aspect of the present invention, which essentially utilises the tubing of the first aspect of the present invention in combination with a drilling tool mounted to the leading end thereof and the annular packer of the tubing is mounted on the outer surface of the tubing.

In this way the alloy suitable for sealing of cavities/fissures that may present during the drilling process can be quickly deployed without the need to remove the drilling tool by simply heating the annular packer and allowing the alloy to flow in to the cavities/fissures, where the alloy can cool and form plugs.

The present invention also provides a method of manufacturing the tubing of the first aspect of the present invention, which in turn can be further adapted for use in the second and third aspects of the present invention.

Specifically the present invention provides a method of manufacturing a gas or oil well tubing, said method comprising: providing a length of tubing; mounting a annular packer to the tubing.

It is envisaged that the oil/gas well tubing of the present invention will be prefabricated in a factory, or possibly on site, before the tubing is deployed down a well bore. This is in clear contrast to the existing approach of deploying eutectic or other bismuth based alloys into the annular space located between existing well tubing and an underground formation (or indeed between adjacent well tubing) and then melting it.

Preferably the annular packer is provided in the form of multiple component parts and the step of mounting the annular packer to the tubing involves securing the component parts together around the circumference of the tubing to complete the annulus. This approach is considered most appropriate for producing the variants of the tubing according to the present invention that has the annular packer mounted on the outer surface thereof.

Alternatively the annular packer is formed within the tubing by: providing melted alloy within the tubing and allowing it to cool; drilling a hole through the alloy along the central axis of the tubing. This approach is considered appropriate for producing tubing according to the present invention that has the annular packer mounted on the inner surface thereof.

In a further alternative the annular packer is formed with the tubing by: locating a blocking tube concentrically within the tubing; providing melted eutectic or other bismuth based alloy within the annular space between the tubing and the blocking tube; allowing the alloy to cool; and removing the blocking tube from within the cooled alloy.

Preferably the method of manufacturing the oil/gas well tubing further comprises providing multiple conduits in the annular packer. As detailed above, the conduits may be in the form of channels in the inner and outer surface of the annular packer. Alternatively the conduits may possibly be in the form of through holes running through the main body of the packer.

The present invention also provides a method of sealing a leak in a completed oil/gas well using the tubing of the present invention by heating the annular packer in situ to melt the alloy and seal the leak.

Preferably a heating tool, such as a chemical heater, can be deployed down the well to apply heat to the annular packer and cause it to melt. Alternatively the tubing may further comprise heating means that can be activated remotely to melt the alloy. In such an arrangement the heating means are preferably in the form of a chemical heat source.

The present invention also provides a method of sealing off cavities/fissures encountered during casing drilling without the need to remove the drilling equipment. This method involves similar features to the method of sealing a leak in a completed oil/gas well described above.

Although the first aspect of the present invention relates to the provision of well tubing provided with an annular packer a further aspect of the invention is considered to be the annular packer on its own.

It will be appreciated that the present invention therefore also provides for annular packers having one or more of the above described features but not being mounted on well tubing.

A fourth aspect of the present invention relates to a gas or oil tubing collar or pup joint, said joint having tubing engagement means that connectably engage a first well tubing to a second well tubing; and further comprising one or more eutectic or other bismuth based alloy rings mounted adjacent to the tubing engagement means.

A pup joint is essentially the same as the collar joint but with the addition of an extended length of pipe between the tubing engagement means that connect to the first and second tubing respectively.

It is envisaged that the alloy could be melted so as to supplement the seal formed by the interaction between the tubing engagement means and the tubing engaged by the collar or pup joint, which is preferably achieved by co-operating screw threads provided by the tubing and the tubing engagement means. Alternatively the alloy may only be employed when a leak is discovered at the collar joint.

Preferably each of the alloy rings is mounted within recess in the collar joint. In this way the alloy does not obstruct the insertion of tubing into the collar.

It is envisaged that when the collar joint is being used to connect two sections of tubing in a substantially vertical plane the alloy ring will be retained in a recess above the tubing engaging means so that when the alloy is melted it will flow downwards under gravity into the join formed between the tubing and the tubing engaging means (e.g. screw thread).

Advantageously the pup joint may further be provided with a temporary plug in the form of a burst disc. In this way the pup joint can be used to provide a temporary plug within the well.

The ability to provide temporary, non-permanent, well plugs is desirable during completion. The above mentioned collar joint provides this functionality during the construction of a well.

BRIEF DESCRIPTION OF THE DRAWINGS

The various aspects of the present invention will now be described with reference to the drawings, wherein:

FIG. 13 shows an end section of the annular packer with a preferred arrangement of rubber seals mounted thereon;

FIG. 14 shows a diagrammatic representation of the interaction between a rubber seal of the annular packer and an adjacent surface;

DETAILED DESCRIPTION OF THE VARIOUS ASPECTS OF THE PRESENT INVENTION

The various aspects will now be described with reference to the Figures, which provide a collection of diagrammatic representations of embodiments of the each aspect of the present invention to aid the explanation of their key features.

One of the central features of a number of the aspects of the present invention is formation of prefabricated oil/gas tubing with a eutectic or other bismuth alloy annular packer mounted to the said tubing. Although the term annular packer is used throughout it is appreciated that the term thermally deformable annulus packer is also an appropriate description given the alloy aspect of the described annular packers. The terms can therefore be used interchangeably.

The term prefabricated is intended to cover situations where the annular packer is mounted on the tubing either in a factory or on site, but always before the tubing is deployed down a well bore. This is clearly distinct from existing uses of eutectic and other bismuth based alloys as a sealant, wherein the alloy is deployed separately from the tubing at a later stage—which is usually after completion of the well.

It will be appreciated that, unless otherwise specified, the materials used to manufacture the components of the various apparatus described hereinafter will be of a conventional nature in the field of oil/gas well production.

Figure 1:
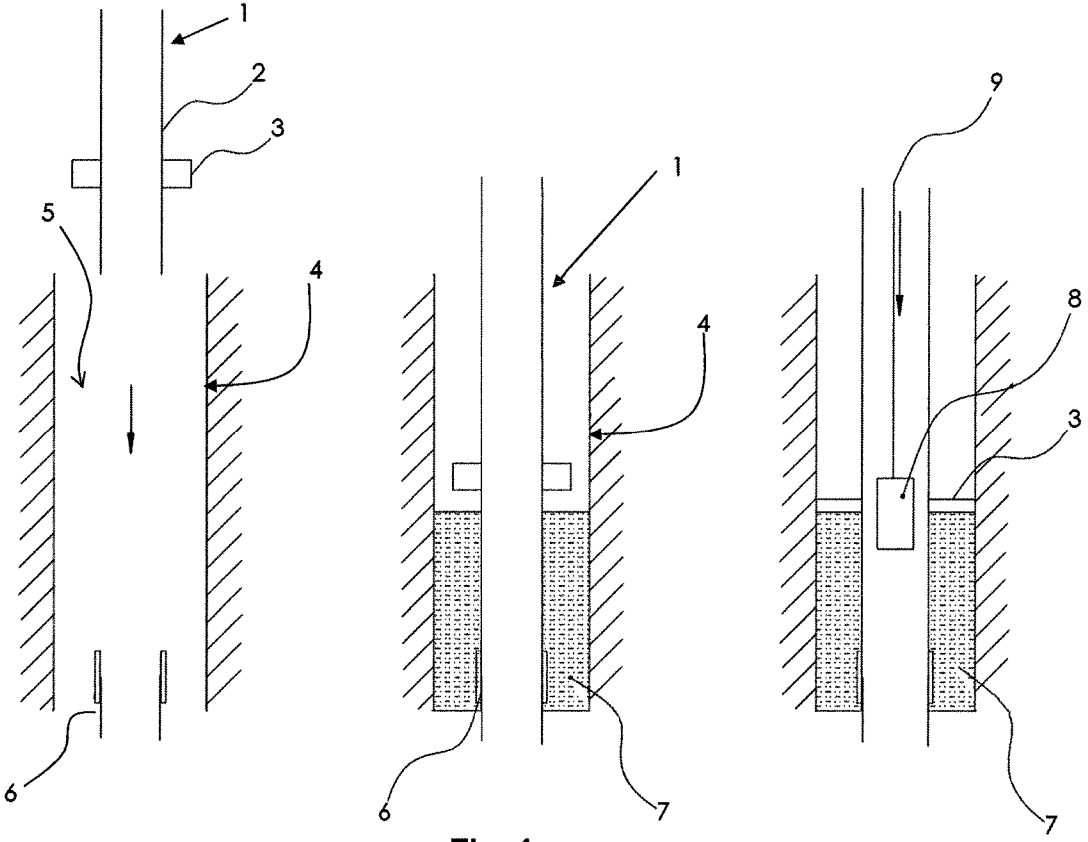
FIG. 1 is a diagrammatic representation of the key stages of the deployment and operation of the oil/gas well tubing of an embodiment of the first aspect of the present invention.
Figure 2:
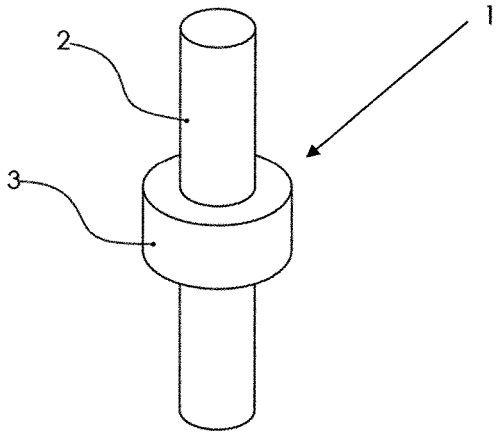
FIG. 2 shows a perspective view of an embodiment of the first aspect of the present invention.

Turning now to the embodiment of the first aspect of the present invention shown in FIGS. 1-4, and in particular FIG. 2 initially. FIG. 2 shows an oil/gas well tubing 1 of the present invention in the form of a length/section of production pipe 2 with an alloy annular packer 3 mounted on the outside thereof.

Although not shown in the Figures it is envisioned that the externally mounted annular packer might preferably be formed from multiple component parts that combine to surround the length of production pipe 2 so that the process of mounting (and possibly remounting) the annular packer is made easier.

As will be appreciated from FIG. 1 the diameter of the annular packer 3 is sufficient to provide a close fit with the outer wall of the well 5, which may be provided by a rock formation 4 or as appropriate a well casing or lining.

In order to explain the benefits of the tubing 1 reference is made to FIG. 1, which shows three key stages in the working life of the tubing 1. In the first stage the tubing 1, which comprises the section of production tubing 2 with the annular packer 3 mounted on the outer surface, is attached to tubing 6 and delivered down the well bore 5 that has been created in the underground formation 4 using conventional means.

It is appreciated that tubing 1 and 6 are typically connected together above ground and then deployed down the well. However in order to clearly illustrate that tubing 1 and 6 are initially distinct they are initially shown in FIG. 1 as being separate.

In the shown example the tubing 1 is attached to the top of the tubing 6. It is envisioned that advantageously the tubing 1 of the present invention may be connected to existing production tubing 6 using the collar joint of the present invention shown in FIGS. 16 and 17, although this is not considered essential. It is appreciated that alternative approaches to deploying a series of sections of well tubing can be employed in concert with the present invention.

Once the production pipework, which comprises tubing 1 and 6, has been deployed within the well 5 cement 7 can be poured or pumped into the annular space between the formation 4 and the pipework (or, if appropriate, between a well casing/lining and the pipework). Once set the cement 7 will seal the well 5 so that the only access to the oil/gas deposit is via the production tubing 1,6.

In the event that a crack or gap develops in the cement seal and forms a leak a heater 8 can be deployed down the well using a wire line 9 or coil tubing, for example, to a target region inside the tubing 1 that is proximate to the alloy annular packer 3. Once in place the heater 9 can be activated to melt the alloy 3, which causes it to turn into a liquid and flow into the cracks/gaps in the cement plug 7.

When the alloy 3 of the annular packer, which may be a eutectic alloy or other forms of bismuth alloy, cools it expands and plugs the cracks/gaps and reseals the cement plug 7 and stops the leak.

It is appreciated that various annular spaces are created during the formation of a well and it is envisioned that the present invention can therefore be usefully employed in variety of different arrangements without departing from the scope of the present invention.

In the described embodiment the cement is poured (or pumped) into the annular space after the tubing 1, with its annular packer 3, has been deployed within the well.

In arrangements where the diameter of the annular packer 3 is close to the internal diameter of the rock formation 4 (or well casing/lining—not shown) it is considered advantageous to provide the annular packer 3 with conduits to facilitate the passage of cement through and around the annular packer 3 so that it can reach the lower regions of the well 5.

Figure 1A:
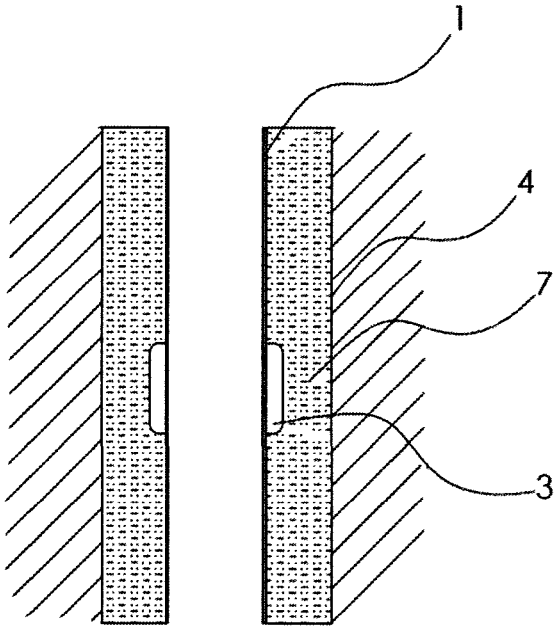
FIG. 1*a* is a diagrammatic representation of an alternative deployment of the tubing of the first aspect.
Figure 1B:
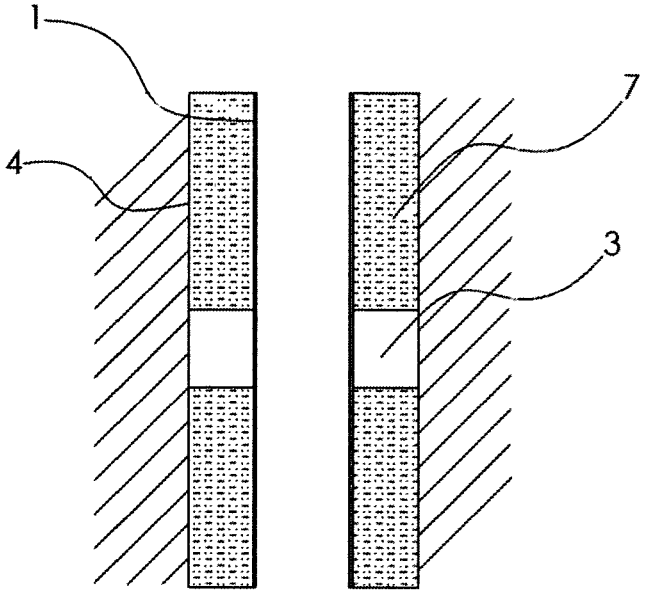
FIG. 1*b* is a diagrammatic representation of a second alternative deployment of the tubing of the first aspect.

It is envisioned that rather than being deployed above the level of the cement the tubing 1 may also be completely surrounded by and embedded within the cement 7. FIGS. 1*a* and 1*b* show such arrangements.

The embodiment of the tubing shown in FIG. 1*a* has an annular packer 3 of a reduced diameter that does not extend all the way to the outer formation (or casing). In is envisioned that such embodiment is suitable for sealing micro annuli leaks; such as those formed by constant expansion and contraction of the production tubing (see above).

The embodiment shown in FIG. 1*b* has an annular packer 3 with a diameter that extends to the surrounding formation (or casing). It is envisioned that this embodiment is more suitable for repairing cracks that extend across the entire cement seal.

Figure 3:
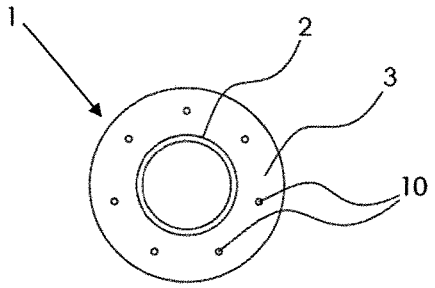
FIG. 3 shows an end view of one variant of the embodiment shown in FIG. 2.

FIG. 3 shows a first variant of the annular packer 3, which is provided with a plurality of through holes 10. The through holes 10 are arranged to permit the passage of wet cement through the main body of the annular packer 3.

Figure 4:
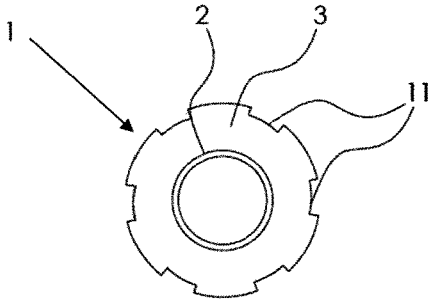
FIG. 4 shows an end view of a second variant of the embodiment shown in FIG. 2.

FIG. 4 shows a second variant of the annular packer 3, which is provided with a plurality of channels 11 in the outer surface of the annular packer 3.

One specific application of the annular packer of the present invention is in the formation of liner hangers. It is envisaged that the alloy annular packer can be used to form an annular seal between a liner and a surrounding surface, such as a well casing or possibly even the surrounding formation. By using an annular packer to form an annular seal located towards the top section (i.e. the section of the liner closest to the ground surface) of the liner the liner can effectively be hung within a well hole.

Figure 5:
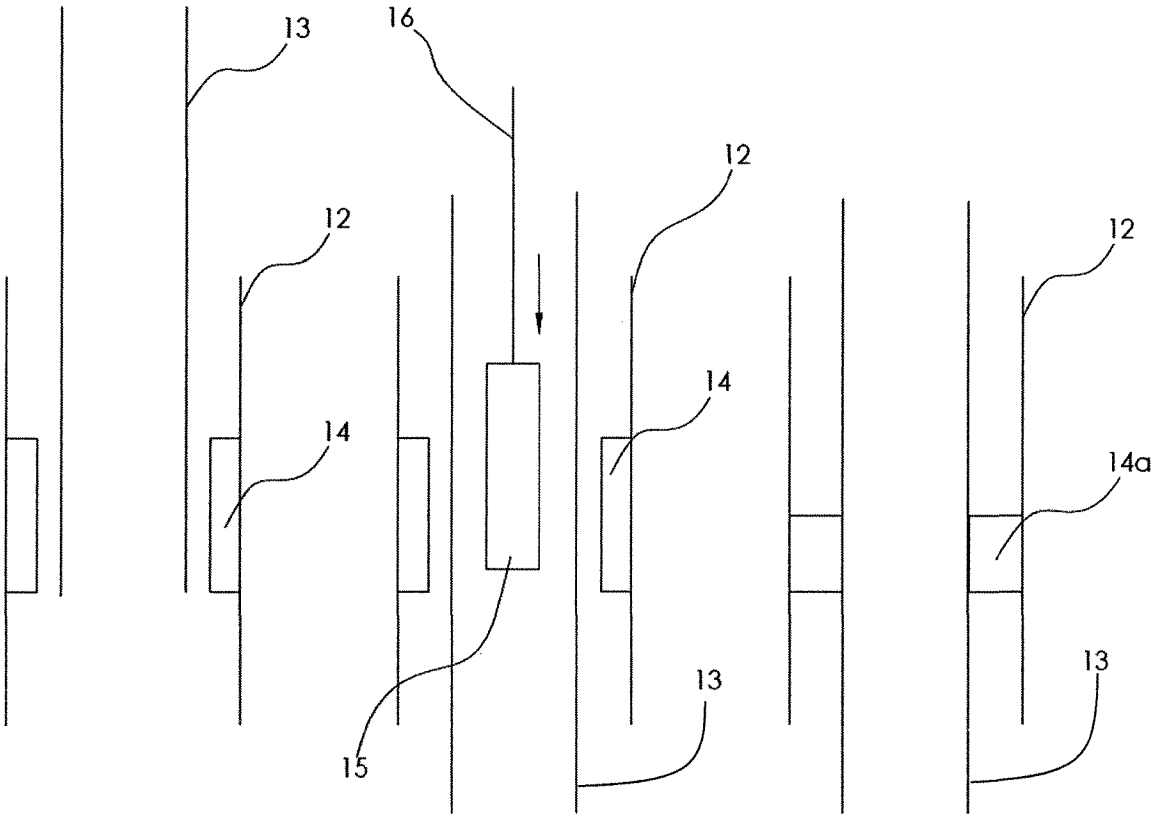
FIG. 5 shows a diagrammatic representation of the key stages of the deployment of a liner hanger in accordance with an embodiment of the second aspect of the present invention.

Turning now to FIG. 5, in which is shown the key stages of deploying a liner hanger in accordance with the present invention within a well hole. It will be appreciated that the outer well casing 12 is essentially the same as the tubing shown in FIG. 8, in that it comprises a length/section of tubing 12 with an annular packer 14 mounted on the outside thereof.

In use the well casing 12 is deployed within a well hole. The well casing 12 is secured in place within the well hole using standard means, although it is envisaged that alloy annular packer might also be used for this purpose.

Although not shown it is envisaged that the well casing (or well liner) may be provided with a skirt or 'cool area' to slow the flow of the melted alloy so that it is not lost down the well but instead cools in the target region. Further details of suitable skirting can be found in International PCT Application No. WO2011/151271. It is appreciated that the well fluids will act to quickly cool the heated alloy ensuring that it is not is a flowing state for very long.

Although not shown, it is envisaged that the skirt may further comprise a swellable or intumescent material that is caused to expand when exposed to heat. This further enhances the ability of the skirt to check the flow of the molten alloy so that it can cool in the target region.

Once the well casing 12 is secured in place within the well a well lining or liner 13 is delivered down the well. The well lining/liner 13 has a diameter that is small enough to enable it to pass inside both the well casing 13 and the annular packer 14.

Once the well lining/liner is located at its required position within the well (i.e. so that the majority of the liner extends down the well away from the annular packer) a heater 15 is deployed, via a cable line 16 (or suitable alternative such as drill pipes), down the well hole and into the well lining/liner 13. The heater 15 is deployed to a target region in which the well casing, the annular packer 14 and the well lining/liner 13 are all aligned.

Once in position the heater, which is preferably a chemical based heated source, is activated and the alloy of the annular packer 14 is melted causing it to sag. After a period of heating that is calculated to adequately melt the alloy the heating stops (and the heater removed) and the alloy is allowed to cool and resolidify. As the alloy resolidifies it forms an annular seal 14*a* between the out well casing 12 and the inner well lining/liner 13.

Figure 5A:
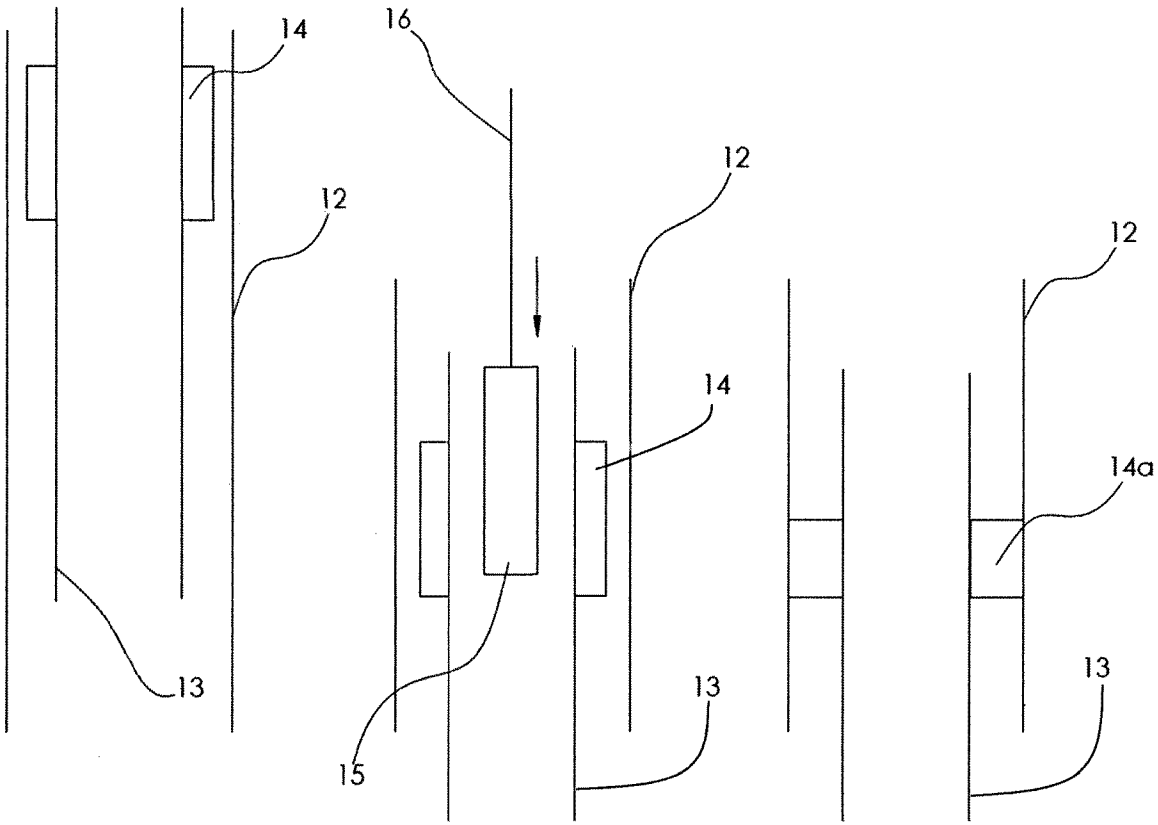
FIG. 5*a* shows a diagrammatic representation of the key stages of the deployment of an alternate embodiment of the second aspect of the present invention.

FIG. 5*a* shows an alternative arrangement of the liner hanger deployment shown in FIG. 5. Although the components involved are the same, rather than mounting the annular packer to the well casing 12, the annular packer 14 is mounted on the outside of the well lining/liner 13. In this alternative arrangement the well lining/liner 13 is essentially the same as the tubing shown in FIGS. 1-4.

The third aspect of the present invention is applicable in casing drilling operations, which are typically employed when drilling into soft or loose formations (e.g. sand, mud, etc . . . ).

Figure 6:
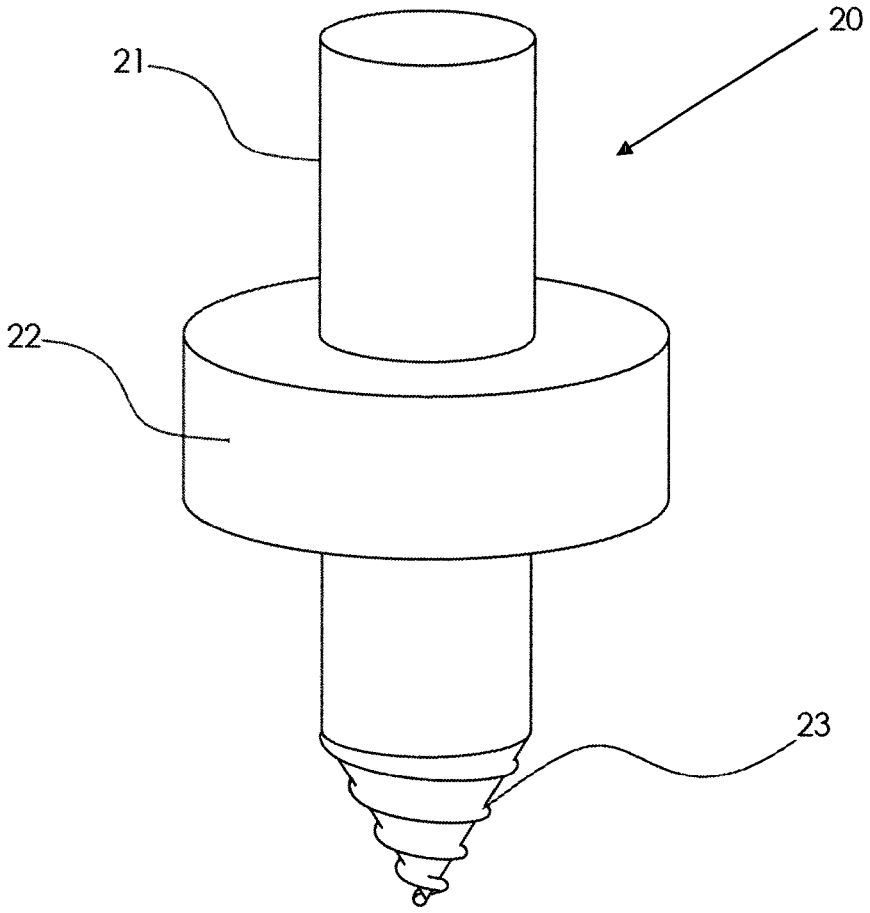
FIG. 6 shows a perspective view of an embodiment of the third aspect of the present invention.

FIG. 6 shows an embodiment according to the third aspect of the present invention. The drilling casing 20 comprises a section of tubing in the form of a well casing 21. An annular packer 22 is mounted in the outer surface of the casing 21. On the leading end of the casing is provided a drill head 23. In use the entire drilling casing 20 is rotated to effect a drilling action on a formation that is comprised of loose material.

It is envisioned that the dimensions of the drilling casing components shown in FIG. 6 are not limiting and the arrangement is primarily provided to demonstrate the principle of operation of the third aspect of the present invention. For instance it is envisaged that the diameter of the drilling head 23 would in practise be closer to that of the annular packer so that the well bore being formed can accommodate the passage of the annular packer 22 as the drilling casing 20 carries out the drilling operation.

Figure 7:
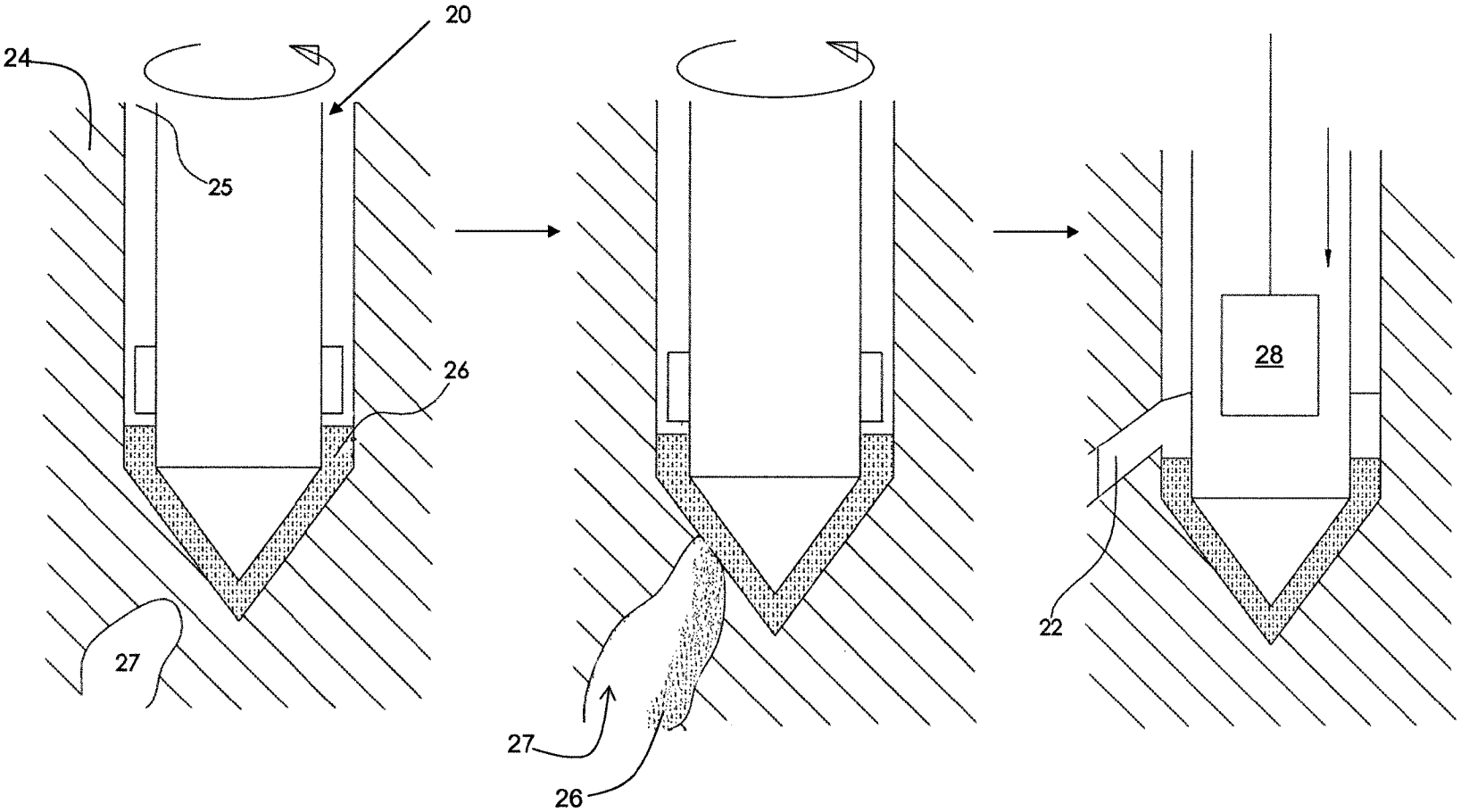
FIG. 7 shows a diagrammatic representation of the key stages of the deployment and operation of the casing drilling variant of the third aspect of the present invention.

The operation of the drilling casing 20 will be better appreciated upon consideration of FIG. 7, which show the key stages of a drilling action. The first stage shown in FIG. 7 represents the standard drilling operation wherein the drilling casing 20 is rotated about its central axis so as to create a well bore 25 in the formation 24. Drilling fluid 26 is provided within the well bore 25 (possibly via the casing 20) to assist the drilling process (i.e. cool the drilling tool and facilitate removal of swarf/drilling waste from the drill face).

The first stage of FIG. 7 shows a cavity 27 in the drilling path of the well bore. In the second stage of FIG. 7 the drilling action has exposed the cavity 27 and in doing so has allowed the drilling fluid 26 to leak away. If left unchecked the loss of the drilling fluid would severely impair the drilling process and could damage the drilling tool 23.

In order to remedy this situation it would normally be necessary to stop the drilling and remove the drilling casing so that a suitable sealing material (such as cement) can be deployed to plug or cap off the cavity. This operation is time consuming and thus, as a result of lost oil production, extremely costly.

As will be appreciated from the third stage shown in FIG. 7, the drilling casing 20 of the present invention provides a much quicker solution because the eutectic or indeed other bismuth based alloy—which is capable of providing an effective plug—is already present in the locale of the cavity. It is therefore simply a case of heating the eutectic/bismuth based alloy 22 so that it melts, flows into the cavity and cools, thereby plugging (or capping off) the cavity.

In FIG. 7, for the sake of aiding understanding, the heating means is shown as a separate heating tool that is deployed down the well, via the inside of the casing 21, until it reaches the target region adjacent the annular packer 22. It is envisaged that an alternative heat source, preferably in the form of a chemical heat source, might be provided on the drilling casing 20 before it is deployed. This could be activated from the surface or remotely (e.g. using a pressure pulse, radio wave, etc . . . ).

The majority of the embodiments described so far have involved the annular packer being mounted on the outer surface of suitable tubing, whether in the form of a section of production tubing, well casing/lining, adaptor tubing or a drilling casing.

However it is envisioned that the annular packer might also be mounted on the inner surface of suitable tubing without departing from the scope of the present invention. It is appreciated that suitable tubing may include sections of well casing and well lining.

Figure 8:
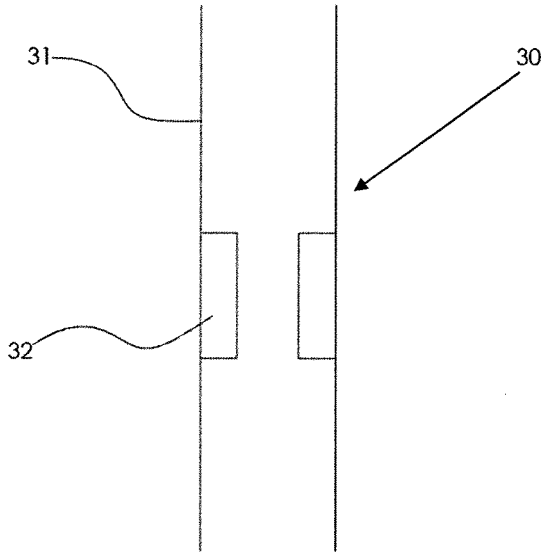
FIG. 8 shows a diagrammatic cross-sectional representation of an alternative embodiment of the first aspect of the present invention.

In this regard reference is now made to FIG. 8, which shows an embodiment of the tubing 30 of first aspect of the present invention wherein the annular packer 32 is mounted within the section of well casing 31 on an inner surface thereof.

Figure 9:
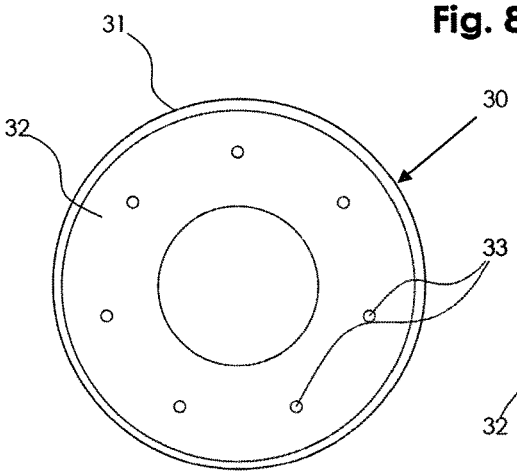
FIG. 9 shows an end view of one variant of the embodiment shown in FIG. 8.
Figure 10:
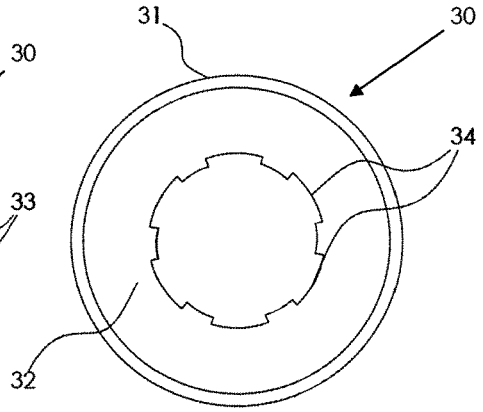
FIG. 10 shows an end view of a second variant of the embodiment shown in FIG. 8.

Once again, as with FIGS. 3 and 4, two variants of the tubing 30 are shown end on in FIGS. 9 and 10. Specifically FIG. 9 shows the variant of the annular packer 32 with cement by-pass conduits in the form of through holes 33, whereas FIG. 10 shows a variant of the annular packer 32 is provided with channels 34 in the inner circumferential surface.

Figure 11:
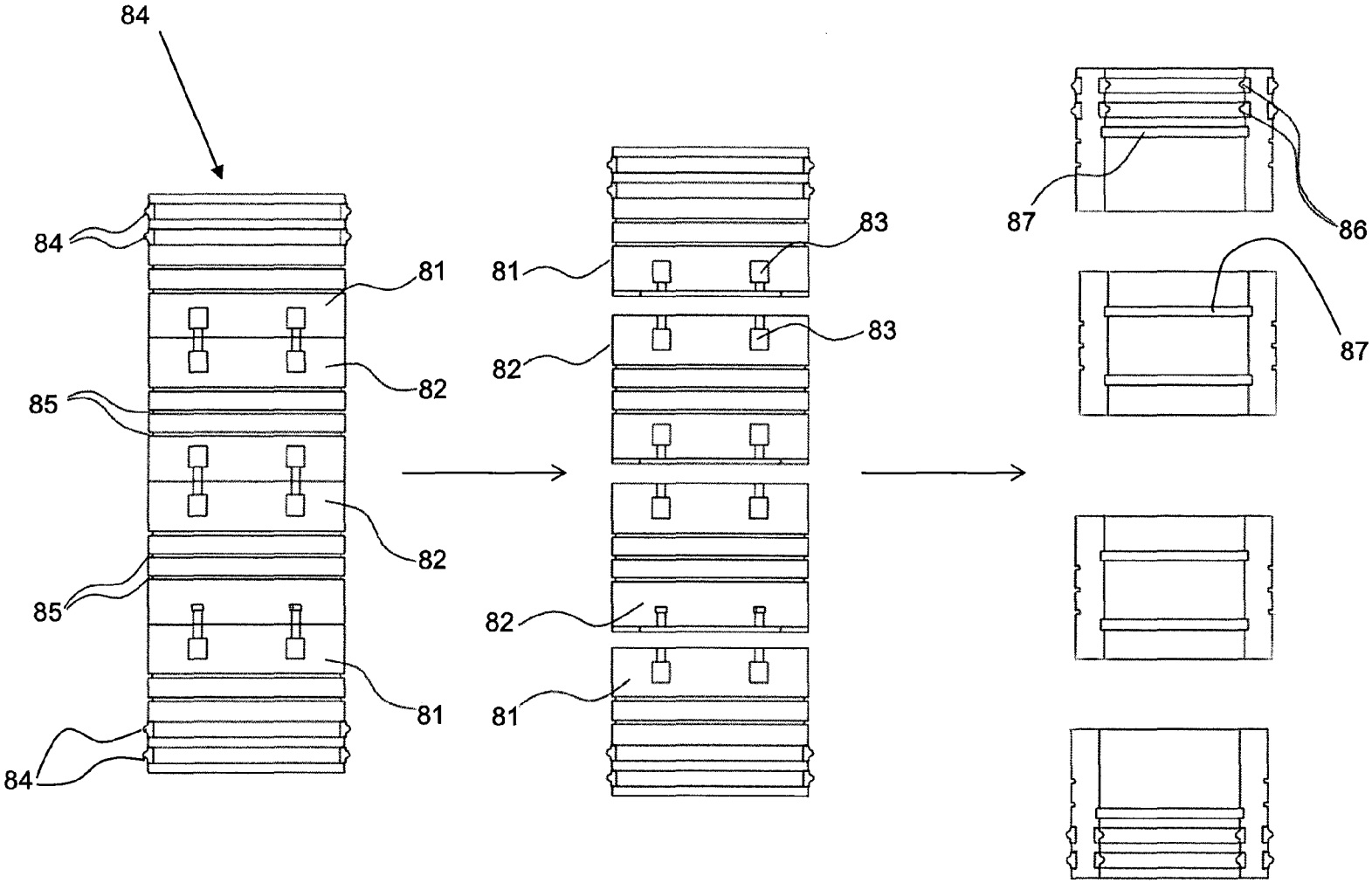
FIG. 11 shows a preferred embodiment of a stackable variant of the annular packer of the present invention.

FIG. 11 show three views (a combined, an exploded, and a cross-sectional) of a preferred stackable arrangement of the annular packer 80. The annular packer is shown without a well casing/tubing as such is not essential to the provision of an operational annular packer.

As will be best appreciated from the exploded view, in the example shown the packer 80 is formed from two end sections 81 and two middle sections 82 all of which are joined together with connection means 83. Although not shown in detail it will be appreciated that that the connection means may be in the form of pairs of nuts and bolts located around the perimeter of the annular packer.

Although the shown example only has four sections it is envisaged that the number of middle sections can be reduced or increased to vary the length of the annular packer, thus making this embodiment much more flexible for a range of repair jobs.

On the outside of each section is provided at least one conduit clearance means 85, which essentially comprise a metal spring ring that has been stretched fit around the annular packer 80. Each spring ring is retained within a recess 91 (see FIG. 12). The spring ring may preferably be made from steel as this is a relatively cheap material. However, in cases where higher temperature tolerances are required it is envisioned that alternative metals and alloys may be employed to form the spring ring.

In stretching the spring ring 85 the conduit clearance means is forced out of its preferred state. The desire of the spring ring to return to its original diameter serves to resiliently bias the conduit clearance means towards the annular packer and the conduits (not shown) that run along its length through the middle of each packer section. Further details of the operation of the conduit clearance means are provided below.

In addition to the conduit clearance means 85, the end packer sections 81 are provided with one or more rubber seals 84. These seals facilitate the formation of a seal between the annular packer 80 and the tubing into which the packer is inserted. In the shown example two rubber seals are provided on each end section so as to allow for one of the seals to fail. This is important because the seals can become damaged during the deployment of the annular packer within an outer tubing structure. In view of this it is envisaged that more than two rubber seals may be provided on each section to provide additional redundancy.

Turning now to the cross-sectional view of the stackable annular packer 80 it will be seen that further seals 86 and conduit clearance means 87 are provided on the inner surface of the annular packer 80.

The seals 86, which are only provided on the end sections 81, are similar in nature to the externally mounted seals 84.

The inner conduit clearance means 87 are once again provided by spring rings. However in contrast to the outer means 85 the inner spring rings are squeezed into the inner space of the annular packer.

In squeezing the spring ring 87 the conduit clearance means is forced out of its preferred state. As with the outer means 85, the desire of the spring ring to return to its original diameter serves to resiliently bias the conduit clearance means towards the annular packer and the conduit (not shown) that runs along its length through the middle of each packer section.

Figure 12:
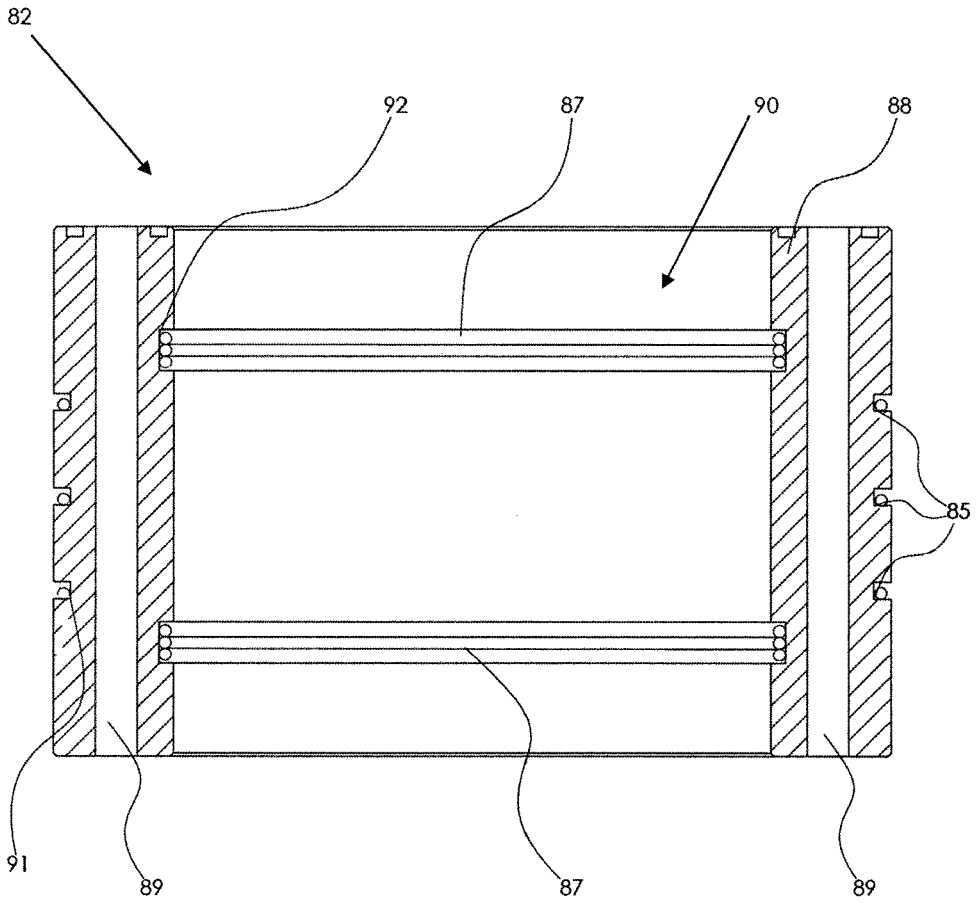
FIG. 12 shows a middle section of the annular packer with a preferred arrangement of conduit clearance means mounted on thereon.

The arrangement of the conduit clearance means 85 and 87 will be better understood from the enlarged cross-sectional view of annular packer section 82 shown in FIG. 12.

The section 82, and indeed each of the annular packer sections, is essentially formed from an alloy 88. Each section is preferably formed by casting the alloy 88 in to the required shape of the annular packer section 82. However, it is also envisioned that the end sections might alternatively be formed from a metal, such as aluminium, to provide additional structural strength to the packer.

The alloy 88 is cast with one or more recesses 91, 92 on its inner and outer surface to receive the above described conduit clearance means 85, 87. The section of eutectic alloy annular packer is also provided with a void 90 into which tubing may be received.

In the shown example the alloy 88 of the packer section 82, and indeed the entire packer 80, is provided with a plurality of conduits 89. As already explained the purpose of each conduit 89 is to permit the flow of fluid, and in particular cement, through the annular packer during the completion of a well or setting of a plug, for instance.

The conduit 89 is defined by the eutectic alloy 88. However once cement has been allowed to flow through the conduit 89, as when cement is being pumped down hole past the annular packer via one or more conduits 89, some cement can remain in the conduit and set there.

The presence of a cement rod formed within each conduit is considered undesirable as it would prevent the alloy from forming a complete alloy plug across the entire annular space (i.e. between the inner tubing, such as a production tubing, and an outer tubing, such as well casing). In view of this it is desirable to break up the cement rod so that an unbroken eutectic plug can form. This is the role of the conduit clearance means 85, 87.

Before the alloy 88 of the annular packer 80 is melted the conduit clearance means 85, 87 are held in abeyance by the body of the alloy. However once the alloy begins to melt and flow the conduit clearance means 85, 87 are no longer held and they are able to 'spring back' to their preferred shape.

This results in the outer conduit clearance means springing inwards towards the conduits and the inner conduit clearance means springing outwards towards the conduits. In both cases this results in any cement that may have accumulated in the conduit being subjected to a smashing force, thereby breaking up the cement. Breaking up the cement allows for melted alloy the form an unbroken plug across the entire annular space.

Turning now to FIGS. 13 and 14, which show enlarged cross-sectional views of the end packer section 81, the operation of the rubber seals 84 will be considered in more detail. The end section 81 is provided with a pair of seals 84 on the outer surface of the end section and on the inner surface of the end section.

The seals are provided within recesses located towards the leading edge of the end section 81 to isolate the main body of the eutectic alloy 88 from any cement that is pumped into the well hole. Preferably the pairs of seals are provided on both the inner surface and the outer surface so as to allow for potential failure of one of the seals during the deployment of the annular packer 80. It is envisaged that more or less seals might be employed as required without departing from the present invention.

In order to aid the description of the seal 84 FIG. 14 is provided to show a further enlarged cross-sectional view of a seal when the packer is inserted within a tubing 93. As will be appreciated from FIG. 14 the seal 84 makes contact with the tubing 93 and in doing so forms a seal.

The seal 84 is provided with at least one aperture 94 so that the seal can be self-energising. When the seal is subjected to high pressure (e.g. fluid pressure) from below the seal (as might occur in a typical installation) the aperture 94 allows the fluid to pass into the inner space 95 of the seal 84. The flow of the high pressure fluid into the inner space 95 serves to further push the seal towards the tubing 93, thereby energising the seal and increasing its sealing properties.

Although not shown in detail it is envisaged that similar seals arrangements can be provided on the inner surface of the packer section 81.

Figure 15:
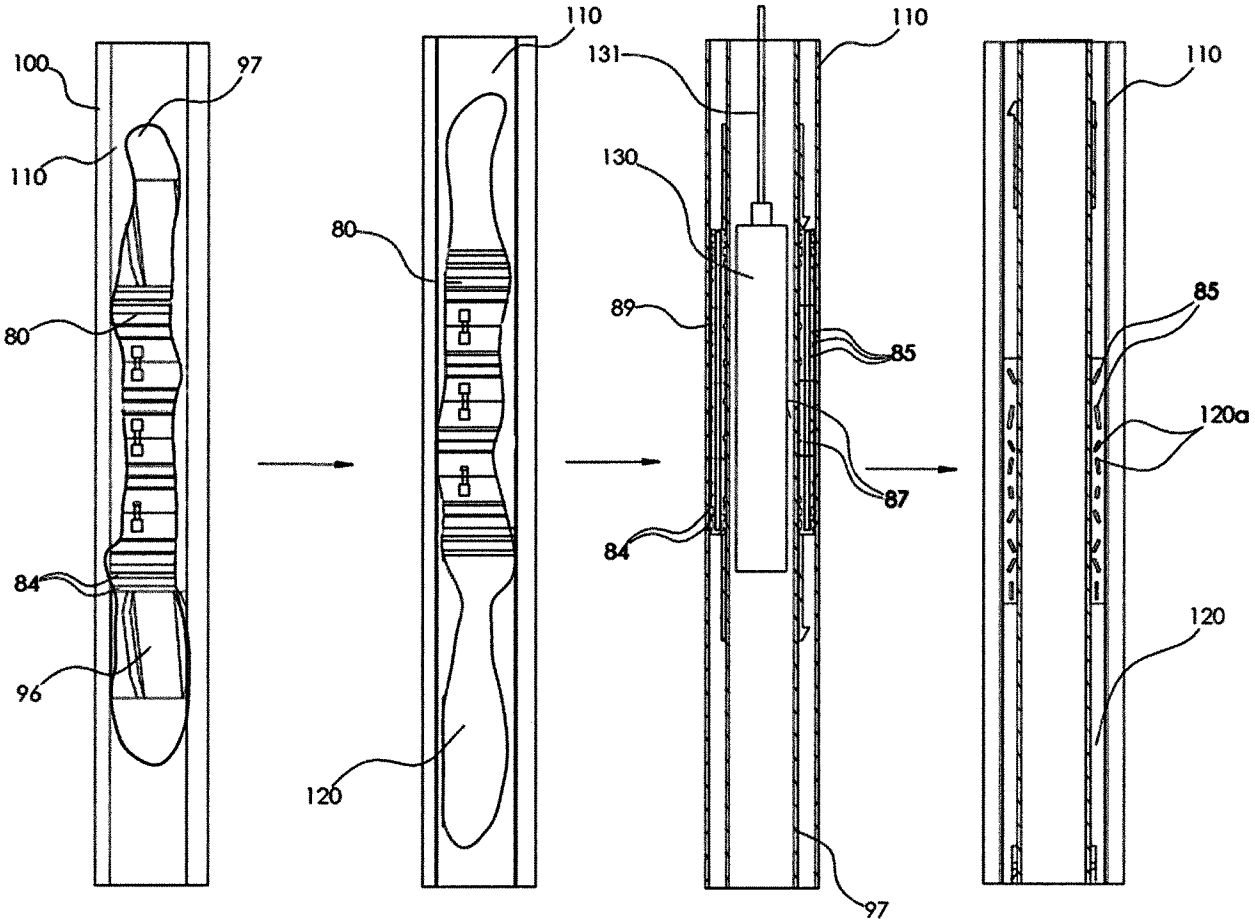
FIG. 15 shows the operational stages of the deployment of a preferred embodiment of the annular packer of the present invention.

The deployment of an annular packer 80 of the present invention will now be described with reference to FIG. 15, which shows some (although not necessarily all) of the stages of the deployment process.

The annular packer 80 is inserted into a well casing/tubing 110 that is located within a well bore in a rock formation 100. The annular packer 80 is mounted on an inner tube 97.

One or more centralisers 96 are provided at the ends of the annular packer 80 to ensure it remains centralised as it is deployed down the well casing/tubing 110. This is desirable as it ensures that the distance between the inner tube (upon which the annular packer is mounted) 97 and the outer well casing/tubing 110 is substantially the same all around the circumference. This in turn aids the formation of a reliable eutectic plug.

Once the annular packer 80 is in position cement 120 is pumped down the well hole via the annular space provided between the inner 97 and outer well 110 tubing. When the cement reaches the annular packer 80 it enters the multiple conduits 89 that are provided therein and flows through the packer to reach the annular space below the packer.

The cement is then allowed to set and form the cement plug between the inner 97 and outer 110 tubes. The annular space above the annular packer may or may not be filled with cement 120 depending on the operational requirements of the well.

At any time after the cement 120 has set a heater can be deployed down the well hole to region of the annular packer 80. This is the third stage shown in FIG. 15. The heater 130, which is deployed using standard delivery equipment such as a wire line 131, then heats the annular packer 80 and melts the alloy so that a plug can be formed in the normal way.

It will be appreciated that the conduits 89 are filled with cement 120. The presence of solid cement path within the body of the alloy is undesirable because such might provide a potential leakage point within any alloy plug formed. In view of this it is important that the cement paths formed within the conduits are broken up. This function is carried out by the conduit clearance means 85, 87.

As will be appreciated from the above description of the conduit clearance means 85, 87, once the alloy 88 of the packer 80 has begun to melt the spring rings are no longer held in position and can spring back towards the conduits. This action imparts a breaking force on the cement rods and smashes them in to smaller non-continuous pieces.

The smaller non-continuous pieces allow the melted alloy to flow and form a continuous uninterrupted alloy plug across the entire annular space between the inner tubing 97 and the outer casing/tubing 110.

Although the above described application of the annular packer relates to the completion of an oil/gas well it is appreciated that the functionality of the packer of the present invention extends to other applications.

For example, the packer can be placed in the annulus during the completion of the well but not melted. Then, when the well comes to the end of its useful life, the annular packer can be melted in the annulus to form a gas tight seal against which a well bore plug can be set. It is envisaged that this would help the company comply with forming a gas tight seal from rock to rock.

Another example of an alternative application is the deployment of the annular packer between producing zones in open hole gravel pack (OHGP). In this way if one zone is watered out the annular packer can be melted to seal off the gravel pack for that zone.

Figure 16:
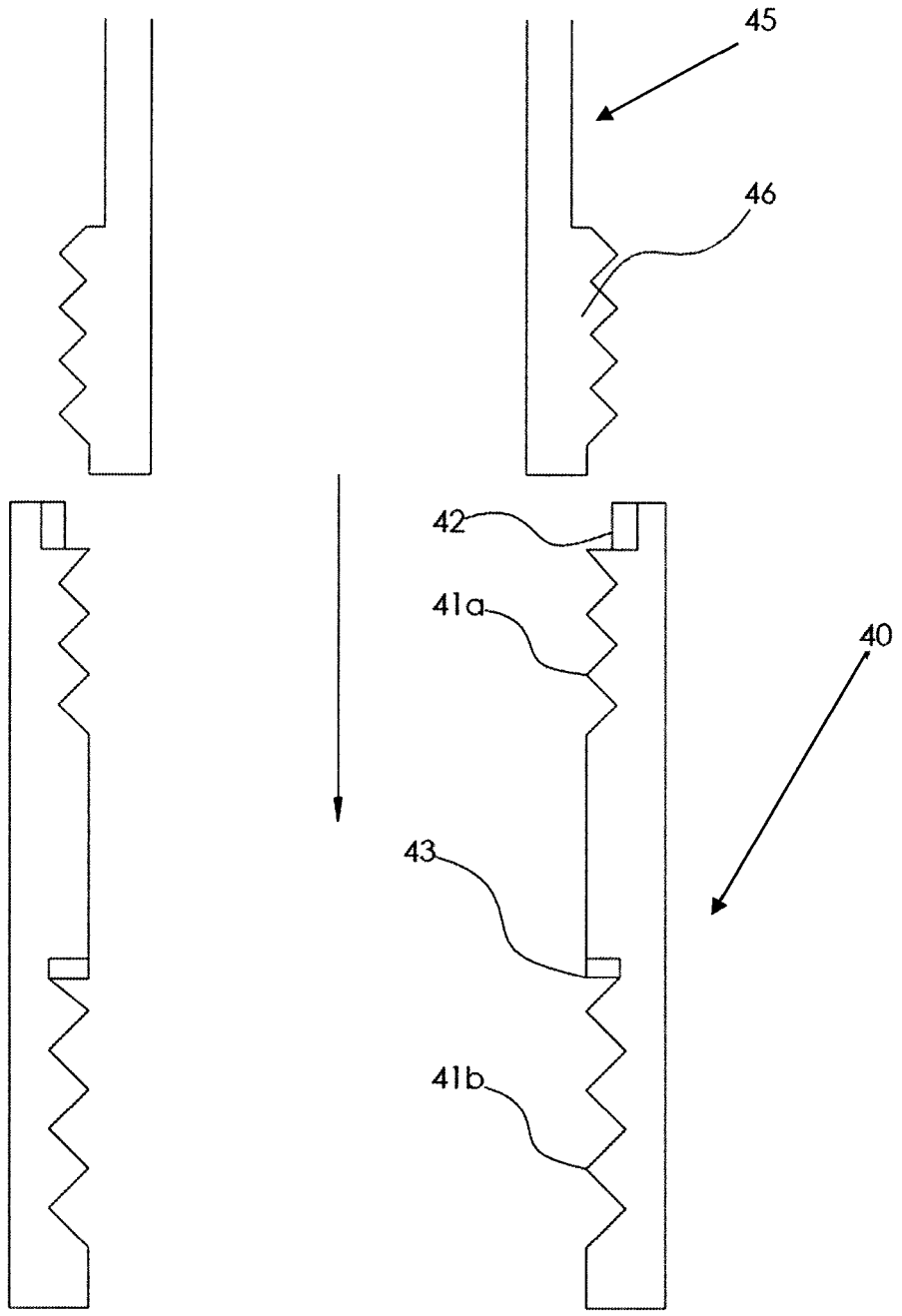
FIG. 16 shows a diagrammatic cross-sectional representation of an embodiment of the collar joint provided by the fourth aspect of the present invention.
Figure 17:
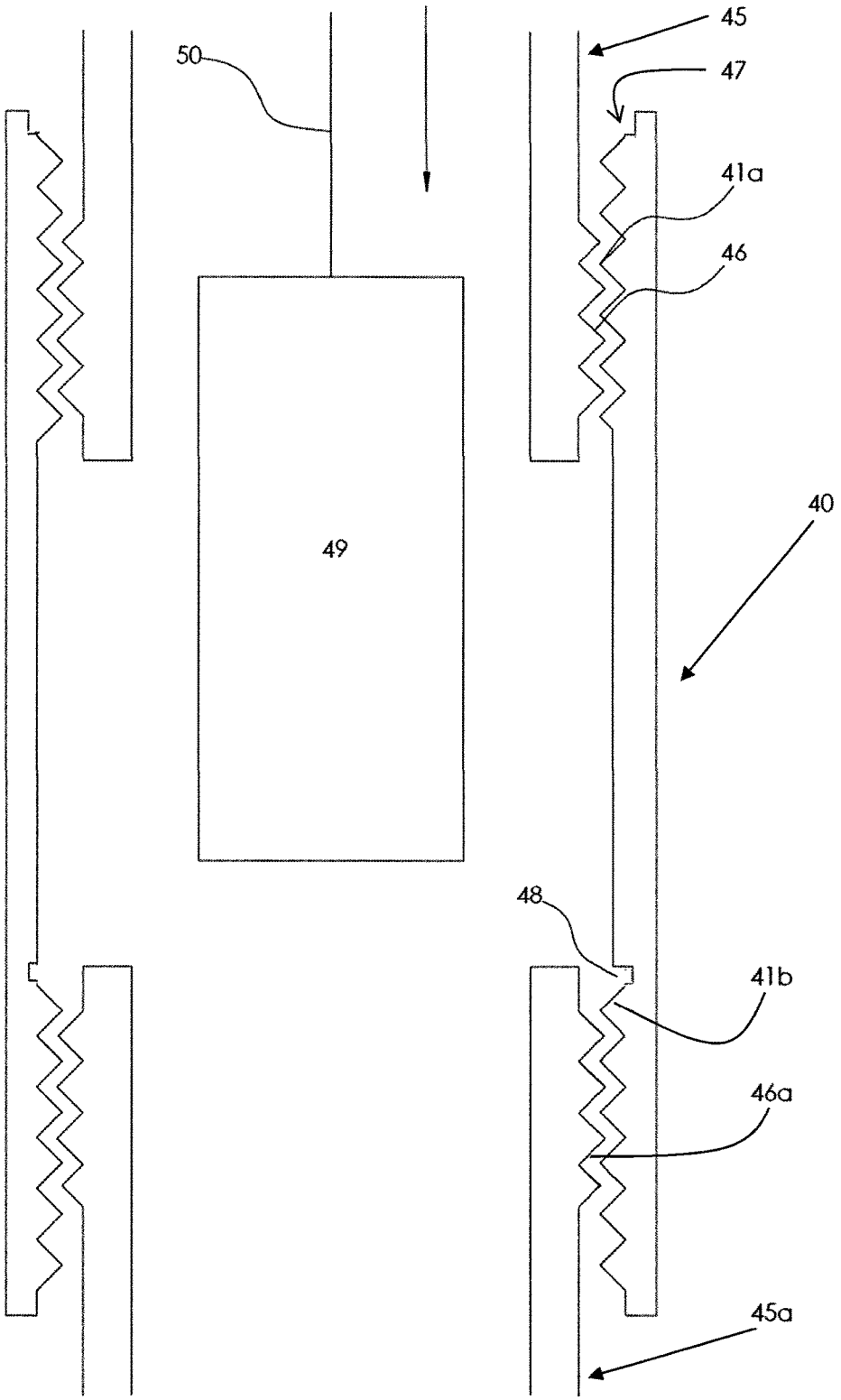
FIG. 17 shows a diagrammatic cross-sectional representation of the embodiment of FIG. 16 being heated to cause the alloy to flow into the join between the tubing and the collar joint.

FIGS. 16 and 17 provide cross-sectional views of an embodiment of a collar joint 40 according to a fourth aspect of the present invention. The collar joint is provided with a first tubing engagement means 41*a* and a second tubing engagement means 41*b*, both in the form of inwardly facing screw threads. As will be appreciated from FIG. 17 in particular the screw thread 41*a* and 41*b* engage with complementary screw threads 46 and 46*a* on tubing sections 45 and 45*a*.

Although the screw threads of the collar joint are shown as facing inwards it is envisioned that the screw orientation of the screw threads on the collar and the tubing could be reversed without departing from the present invention (i.e. the screw threads on the tubing could face inwards and the threads on the collar could face outwards).

In the embodiment being described the collar joint is provided with two separate rings 42 and 43 or eutectic/bismuth alloy, one for each screw thread. The upper alloy ring 42 is located in a recess (shown as 47 in FIG. 12) located above the upper screw thread 41*a* of the collar joint

40. The lower alloy ring 43 is located in a recess (shown as 48 in FIG. 12) above the lower screw thread 41*b*.

When the tubing 45, 45*a* is screwed into the collar joint 40 the recessing of the alloy rings ensures that they do not create an obstruction.

In the event that the joint between the adjacent sections of tubing 45, 45*a* develops a leak heater 49 is deployed via the tubing 45 to a point that is adjacent the collar joint 40 via a standard delivery means 50 (e.g. wire line). Once in place the heater 49 can be operated to heat the alloy rings, which can then flow under gravity into the screw threaded joint located below the respective recesses 47, 48. The alloy is then allowed to cool and expand within screw threaded region to enhance the seal formed.

Although the alloy rings are intended for use only when a leak develops at a joint it is also envisaged that the alloy may be deployed even when there is not leak with the sole purpose of providing an enhanced seal at a joint section.

The invention claimed is:

1. A method of manufacturing a gas or oil well tubing, said method comprising:

providing a length of tubing; and mounting a eutectic/bismuth alloy annular packer to the tubing;

wherein the annular packer is formed within the tubing by:

locating a blocking tube concentrically within the tubing;

providing a melted eutectic/bismuth alloy within the annular space between the tubing and the blocking tube;

allowing the alloy to cool; and removing the blocking tube from within the cooled alloy to leave a void.

2. A thermally deformable annular packer formed from an eutectic or bismuth based alloy and configured to be mounted to a gas or oil well tubing, said packer comprising:

one or more conduits oriented at least substantially parallel to the central axis of packer so as to permit the flow of fluid through the packer when the packer is mounted on a gas or oil well tubing; and one or more resiliency biased conduit clearance means located adjacent to said one or more conduits, wherein said clearance means are biased towards said conduits;

wherein the conduit clearance means are held away from the conduit by alloy, such that when the alloy is melted the conduit clearance means can move towards said conduits under the biasing force.

3. The annular packer of claim 2, wherein the conduit clearance means comprise one or more ring springs mounted in recesses in either the inner, the outer or both the inner and outer surfaces of the annular packer.

* * * * *